United States Patent [19]

Rush

[11] 4,323,605

[45] Apr. 6, 1982

[54] CAMOUFLAGE INCISING GEOMETRY

[75] Inventor: Charles R. Rush, DeLand, Fla.

[73] Assignee: Brunswick Corporation, Skokie, Ill.

[21] Appl. No.: 113,468

[22] Filed: Jan. 21, 1980

Related U.S. Application Data

[63] Continuation of Ser. No. 928,880, Jul. 28, 1978, abandoned, which is a continuation of Ser. No. 723,331, Sep. 14, 1976, abandoned.

[51] Int. Cl.[3] ..... F41H 3/02

[52] U.S. Cl. ..... 428/17; 343/18 E; 428/134; 428/919

[58] Field of Search ..... 156/252, 253; 428/17, 428/134, 136, 155, 224, 247, 255, 256, 919, 15; 343/18 E

[56] References Cited

U.S. PATENT DOCUMENTS

| | | | |
|---|---|---|---|
| 875,595 | 12/1907 | Overbury | 428/134 X |
| 2,911,652 | 11/1959 | Ekman | 428/919 X |
| 3,069,796 | 12/1962 | Ruter | 428/919 X |
| 3,733,606 | 5/1973 | Johansson | 428/919 X |

FOREIGN PATENT DOCUMENTS

| | | | |
|---|---|---|---|
| 756383 | 9/1956 | United Kingdom | 156/253 |

*Primary Examiner*—Henry F. Epstein

*Attorney, Agent, or Firm*—George J. Porter

[57] ABSTRACT

A sheet of camouflage material is provided for concealing people and equipment from people or animals having a sense of color or geometric perception. The sheet has a plurality of alternating rows of straight-sided, upright V-shaped cuts with intermediate rows of inverted V-shaped cuts. The upright V-shaped cuts line up vertically in alternating columns with intermediate columns of inverted "V" cuts. Each shaped cut is comprised of a long straight incision and a short straight incision which intersect to form a triangularly-shaped point. The ratio of the lengths of the short incision to the long incision and the ratio of the spacing between points of the adjoining shaped cuts in a column and the length of the long incision are defined so as to produce a sheet of camouflage material which, when stretched, produces a three-dimensional effect with sharp points simulating grass or leaves with a height in the third dimension between three and four times the height of previous incised camouflage sheets. The increased height or increased third dimension improves concealment from radar. Controlled stretching of the sheet results in a particular and predictable see-through factor which is commensurate with the radar return. Less blades are necessary to incise the material and they are cheaper to build and cheaper to maintain.

6 Claims, 4 Drawing Figures

CAMOUFLAGE INCISING GEOMETRY

This is a continuation, of application Ser. No. 928,880, filed on July 28, 1978, which in turn is a continuation of application Ser. No. 723,331, filed on Sept. 14, 1976, both now abandoned.

BACKGROUND OF THE INVENTION

1. Field of the Invention

This invention relates to camouflage material and, more particularly, to an improved incising arrangement for said material to produce an improved three-dimensional effect.

2. Description of the Prior Art

Camouflage material for civilian and military use has generally been found to be most effective where the material has openings and will assume a posture with respect to the equipment or persons being disguised that best simulates the surrounding grass, leaves, or the like. As is probably best illustrated in the Rüter U.S. Pat. No. 3,069,796, a sheet of material is incised with U-shaped cuts in a symmetrical pattern such that stretching the material will cause the U-shaped members to project upward in a somewhat three-dimensional effect. It has been found with incising of the type shown in U.S. Pat. No. 3,069,796 produces a relatively high see-through factor and, due to the tendency for the round ends of the U-shaped members to flop over or curl, to produce a somewhat flattened three-dimensional effect.

The Ekman U.S. Pat. No. 2,911,652 shows another camouflage material wherein the cutouts of different sizes and shapes, when strung together and drawn in, will produce an uneven three-dimensional effect.

Both of the above-mentioned prior art devices and other prior art devices, although possessing excellent camouflaging characteristics, such as from an airplane or the like, are not quite as realistic as is desired at closer range or on radar. The lack of realism is partially due to the tendency for the U-shaped cutouts of the Rüter patent or the spacings between the cutouts of the Ekman patent to be rounded causing them to flop or to curl. Thus, although the prior art does create a three-dimensional effect, such three-dimensional effect is somewhat flat, thereby resulting in a somewhat less than realistic visual contrast and a somewhat greater defined radar signature.

SUMMARY OF THE INVENTION

An improved sheet of camouflage material is provided which closely duplicates natural herbivorous vegetation and growth by controlling the see-through and enhancing the three-dimensional effect. The improved incised material prevents people and animals having the ability to detect differences in color and who have geometric perception from readily spotting equipment or people covered by said material. The improved material has an incising arrangement that is capable of producing a deeper three-dimensional effect that more nearly simulates natural grass, tree leaves and the like. The improved material has particular application for use in duck blinds, ground-to-ground military targets, and the like, as well as exceeding existing specifications for military camouflage, such as air-to-ground targets, and the like.

By incising a blank sheet of material with straight cuts that intersect to form V-shaped members, with the lengths of the cuts being controlled and the ends of the cuts overlapping in a particular manner, will produce a controlled accentuated three-dimensional effect when the material is stretched with the points of the V's sticking substantially straight up or straight down. This provides an improved three-dimensional effect of grass, leaves or surrounding terrain which creates a better visual concealment and a more degraded radar signature.

The angle of the cuts and the ratio between the lengths of the cuts and the ratio between the long cut and the distance point-to-point between aligned adjacent V-shaped members are within precisely defined ranges so as to create the accentuated three-dimensional effect when the material is stretched. The improved camouflage sheet reduces the percent of see-through under controlled degrees of stretch while providing the accentuated three-dimensional effect, so as to closely duplicate natural herbivorous vegetation and growth.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
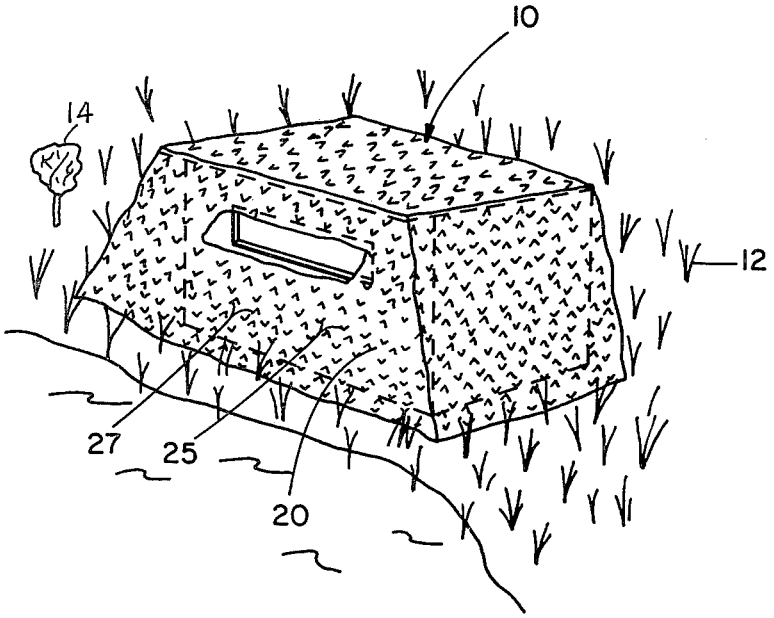
FIG. 1 is a perspective view of a duck blind in a natural environment and covered by a sheet of the improved camouflage material.

Referring to the drawings, and particularly to FIG. 1, a low structure 10 is illustrated in a natural herbivorous setting with vegetation, such as grass 12, bushes 14 having leaves, and trees (not shown) also bearing leaves. The structure 10 is covered over with a stretched sheet 20 of camouflage material having incising cuts 25,27 formed therein. It is to be understood that the structure 10 could be a military structure or could contain equipment or personnel, the purpose of the camouflage being to not only prevent detection from the air, but also to prevent detection from the ground.

Figure 2:
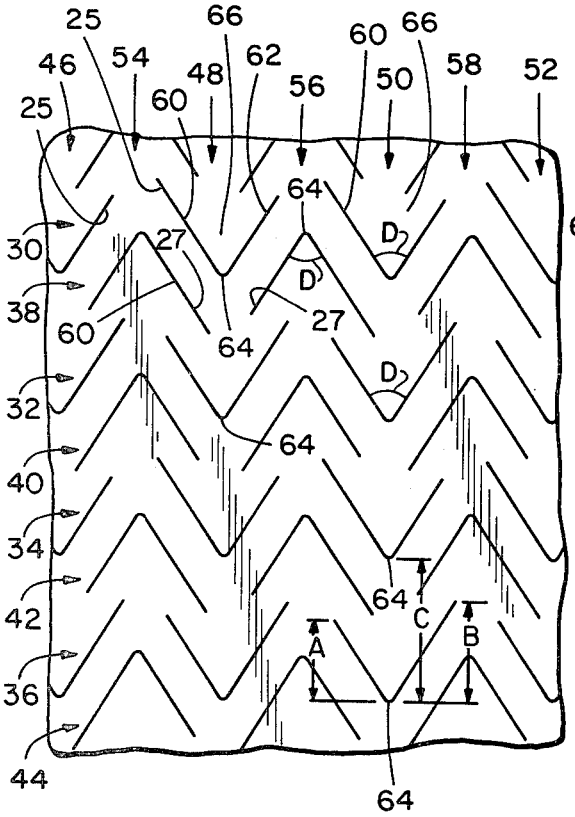
FIG. 2 is a plan view of a portion of a sheet of camouflage material having the improved incising pattern cut therein.

FIG. 2 illustrates the sheet 20 of material having an incising pattern cut therein, the pattern consisting of a plurality of alternating rows 30,32,34 and 36 of upright V-shaped cuts 25 with intermediate alternating rows 38,40,42 and 44 of inverted V-shaped cuts 27 therebetween. The upright V-shaped cuts 25 are vertically aligned in alternating columns 46,48,50 and 52 with intermediate alternating columns 54,56 and 58 of inverted V-shaped cuts 27 therebetween. It should be noted that each upright V-shaped cut 25 and inverted V-shaped cut 27 has one long cut or long leg 60 and one short cut or short leg 62, with the long cut 60 intersecting the short cut 62 substantially at a point or apex 64 with a preferred included angle "D" of between 60 and 70 degrees. The cuts 60,62 produce a triangularly-shaped member 66 which is hingedly attached to the sheet generally along an imaginary base line extending between the free ends of the cuts 60,62. It should be noted that every other row of upright V-shaped cuts 25, for instance rows 30 and 34, have the long cut or leg 60 on the left side as viewed in FIG. 2, with the short cut or leg 62 on the right side thereof. The alternating rows 32,36 of upright V-shaped cuts 25 have the short leg 62 on the left-hand side and the long leg 60 on the right-hand side. Likewise, the inverted V-shaped cuts 27 in rows 38 and 42 have the short cuts 62 on the left-hand side and the long cuts 60 on the right-hand side. The intermediate rows 40,44 have the long cuts or legs 60 on the left-hand side and the short cuts or legs 62 on the right-hand side.

Each adjacent pair of upright V-shaped cuts 25 have one short leg 62 of one cut adjoining a long leg 60 of the adjacent V-shaped cut 25. The same is true for the inverted V-shaped cuts 27. Also, each adjoining pair of upright V-shaped cuts 25,25 have an inverted V-shaped cut 27 overhanging the ends of the cuts 60,62 of said adjoining V-shaped cuts. The same is true of each pair of adjacent inverted V-shaped cuts 27 in that the ends of the adjacent legs or cuts 60,62 of the pair have an upright V-shaped cut 25 overlapping the ends thereof. In FIG. 2, each cut or leg 60,62 has a vertical component and a horizontal component, the vertical component of the short leg 62 being designated by the letter "A" and the vertical component of the long cut or leg 60 being designated by the letter "B". From the tip or point 64 of one upright V-shaped cut 25 to the tip or point 64 of the next vertically adjacent V-shaped cut 25 is designated by the letter "C". It should be noted that the vertical component of each short cut or leg 62 and long cut or leg 60 of each upright V-shaped cut 25 or each inverted V-shaped cut 27 is substantially the same as is the vertical component of each other short cut or leg 62 and long cut or leg 60 of each V-shaped cut. The point 64 to point 64 distance "C" between vertically adjacent cuts 25,25 or 27,27 is the same whether the cuts are inverted or upright V-shaped cuts.

Figure 3:
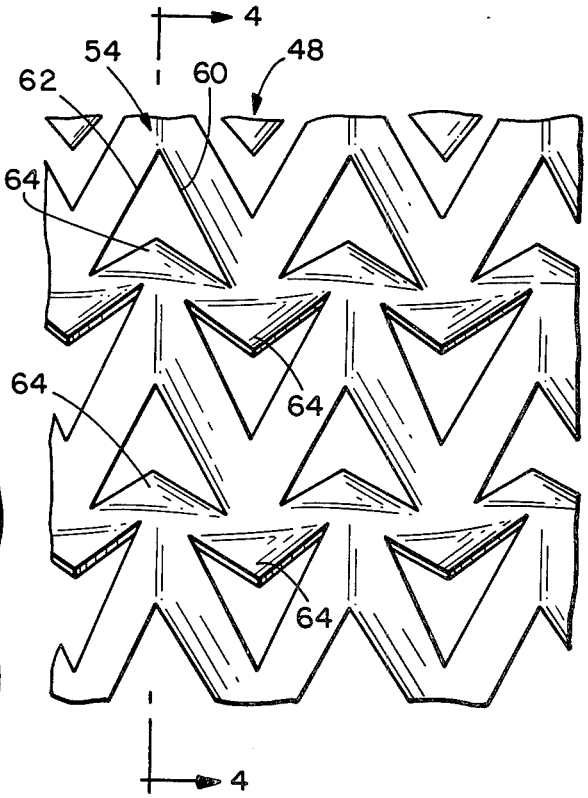
FIG. 3 is a plan view of the portion of the sheet of material of FIG. 2 having a predetermined degree of stretch applied thereto.

It has been found that for a vertical component "B" of a long leg or cut 60 of a given dimension and a point-to-point distance of "C" of a greater dimension, that the distance "C" must not be less than seventeen percent (17%) greater than the vertical component "B", nor more than thirty-three percent (33%) greater than the vertical component "B". Stated another way, the distance from point-to-point designated "C" must be between a minimum of seventeen percent (17%) greater than "B" and a maximum of thirty-three percent (33%) greater than "B" to assure the results desired. Likewise, the vertical component "B" must be not less than twelve percent (12%) greater nor more than twenty-five percent (25%) greater than the vertical component "A". The preferred component for "B" is approximately sixteen percent (16%) greater than the vertical component "A". Using these values on a sheet of incised camouflage material, according to FIG. 2, vertical stretch, that is stretch in the direction of the columns of upright and inverted V-shaped cuts, sufficient to produce a ten percent (10%) stretch of the material produces a camouflage sheet having a see-through factor of approximately twenty-eight percent (28%). The same sheet stretched in the same direction to apply a twenty percent (20%) stretch to the material, such as is illustrated in FIG. 3, will produce a see-through factor of approximately thirty-six percent (36%) and a radar transmission of twenty-six percent (26%).

Figure 4:
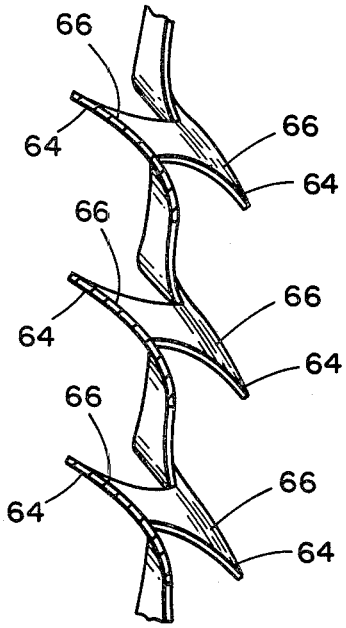
FIG. 4 is a cross-sectional view taken along the lines 4—4 of FIG. 3.

The points 64 of the members 66 of the V-shaped cuts 25,27 will protrude almost perpendicular to the plane of the sheet, such as is illustrated in FIG. 4, with one column 54 of members 66 projecting upward with respect to the plane and the adjacent column 48 of members 66 projecting downwardly from the plane of the sheet. Due to the uneven lengths of cuts of the legs 60,62 of the inverted and upright V-shaped cuts 25,27 and the orientation of the ends of the cuts of each inverted or upright cut with respect to the ends of the adjacent cuts, results in the hinged members 66 sticking substantially straight up and straight down with respect to the plane of the sheet. The forces needed to stretch the material applies an uneven pull on the hinge of the hinged members 66 causing each member 66 to cup slightly thereby adding a degree of stiffness to the member causing it to stand substantially straight up with respect to the plane of the sheet.

The straight standing of the V-shaped cutout members 66, together with the pointed shape of said cutout members, produces the visual illusion of natural herbivorous vegetation, such as grass, leaves, bushes, and the like, so that people or animals that have the ability to preceive color and depth have difficulty in distinguishing the natural herbivorous vegetation from the simulated vegetation created by the present invention.

In at least one prior art structure, a sheet of material is incised with overlapping U-shaped cuts of approximately the same size as described hereinabove, such that when the material is stretched so as to elongate the sheet by ten percent (10%), the see-through factor is approximately thirty-four percent (34%) and when the sheet is stretched to twenty percent (20%) of its original length, the see-through factor is forty-three percent (43%) and the radar transmission is thirty-three percent (33%). In addition, the curved points of the U-shaped members have no stiffness or rigidity and, accordingly, lay over or flop with respect to the plane of the sheet thereby affording only a little three-dimensional effect to the sheet. For comparison purposes, a sheet of camouflage using the prior art U-shaped incising of the same dimension as my improved sheet of V-shaped incising with the ends of the incising according to my invention, it has been found that with a twenty percent (20%) stretch applied to each sheet, the sheet with the U-shaped incising produced a dimension in the direction perpendicular to the plane of the sheet equal to 0.75 inches while the improved V-shaped incised sheet produced a dimension in the direction perpendicular to the plane of the sheet equal to 2.75 inches. That is a substantially four times greater third-dimensional effect for the improved V-shaped incising sheet. Likewise, the see-through factor for the ten percent (10%) stretch of the V-shaped cut sheet being twenty-eight percent (28%) and for the U-shaped cut sheet being thirty-four percent (34%) constitutes a seven percent (7%) less see-through factor for the improved sheet, which see-through factor is controllable. At a twenty percent (20%) stretch, the U-shaped cut sheet had a see-through factor of forty-three percent (43%) and a radar transmission of thirty-three percent (33%) compared to the see-through factor of thirty-six percent (36%) and a radar transmission of twenty-six percent (26%) for the V-shaped cut sheet making a seven percent (7%) reduction in see-through and radar transmission. Since it is desirable to have less radar transmission, the seven percent (7%) reduction in transmission results in a substantially improved camouflage material.

In the prior art structure, the cuts were not able to effect a controlled pattern in the stretched condition since the curve U-shaped flaps flopped over and obstructed the see-through making it difficult to determine exactly what was the see-through factor. With the improved V-shaped incising, since each V-shaped member assumes a definite orientation with respect to the plane of the sheet, the see-through factor is controllable and predictable. It has been found that the V-shaped configuration for any given stretch can be manufactured using twenty-five percent (25%) less blades in the die, thereby making it less costly to build, repair and replace the dies for cutting the improved V-shaped incised sheet.

In camouflage technology, the control of see-through is commensurate with the radar return. See-through is controlled by one of two methods, the first method being by controlling stretch and the second method being by increasing or decreasing the point-to-point distance between vertically adjacent cut-outs; in the present case the point-to-point distance is dimension "C" in FIG. 2. The control of see-through is desirable, first, for visual concealment and, second, for radar signature degradation. The visual concealment and radar signature degradation are improved, first, when the see-through is controlled to a minimum consistent with the necessary open space to give visual contrast and, second, when the third dimension is increased without sacrificing increased see-through. Therefore, where the improved V-shaped cuts are used to incise a camouflage sheet, the see-through is reduced seven percent (7%) while the radar transmission is reduced seven percent (7%) and the third-dimensional effect is increased by four times, thereby producing a camouflage sheet having improved visual concealment and an improved radar signature degradation.

In the prior art constructions, in order to get more stretch, it was necessary to increase the size of the cut. The increased sized cuts only increased the amount of flop over of the cut parts thereby not improving the result needed. In the present situation, since the points stick out, it is possible to get the stretch and the see-through without increasing the size of the cut.

The V-shaped incised cut with the uneven length of legs having a controlled ratio of the length of the legs with respect to each other and with respect to the point-to-point vertically adjacent distances between adjoining cuts, produces an improved camouflage material duplicating natural herbivorous vegetation and growth. It being understood that the surface of the sheet of camouflage material is to be colored in a way to simulate natural colors, the opposite sides of the sheet can be differently colored or can be commonly colored, or different patterns of coloring can be placed on the sheets so as to create the desired effect when the sheets are stretched in the field.

I claim:

1. A camouflage material for covering and stretching over a structure to prevent visual and radar detection thereof, said camouflage material being formed of a planar sheet of material having top and bottom surfaces, a vertical dimension and a horizontal dimension substantially perpendicular to said vertical dimension, and a plurality of spaced apart horizontally aligned rows and vertically aligned columns of V-shaped cuts therethrough, each V-shaped cut comprising two straight unequal in length cuts defining a triangular member hinged about a base angularly disposed with respect to the horizontal dimension of the sheet and having a central axis bisecting the angle formed between the legs which axis is substantially aligned in the vertical dimension of said sheet, alternate rows of V-shaped cuts being inverted with respect to intermediate rows of V-shaped cuts with the inverted V-shaped cuts being further aligned in alternate vertical columns intermediate vertical columns containing the upright V-shaped cuts, the longer length cut of each triangular member having an end adjacent to the end of the shorter length of cut of the adjacent triangular member, the vertical component of the longer length of cut being from 12% to 25% greater than the vertical component of the shorter length of cut of each V-shaped cut whereby stretching said material in a direction transverse to the rows of V-shaped cuts extends the apexes of the triangular members in one row upward out of the plane of the sheet away from said top surface with the next adjacent row of cuts extending the apexes of the triangular members downward out of said plane away from said bottom surface, said V-shaped cuts projecting from said surfaces substantially straight relative to the plane of said sheet to prevent viewing of both of said surfaces simultaneously from one side of said sheet.

2. The camouflage material as claimed in claim 1 wherein the vertical dimension of the longer length of cut is from 17% to 33% of the distance from one apex on one V-shaped cut to a comparable apex on the next vertically adjacent V-shaped cut in a column of V-shaped cuts.

3. A camouflage material having improved three dimensional effect for degrading radar signature thereof and concealing objects covered thereby, said material being formed of a sheet of material having top and bottom surfaces, a vertical dimension and a horizontal dimension substantially perpendicular to said vertical dimension, a plurality of vertically spaced apart rows of upright V-shaped cuts extending horizontally across the sheet, a plurality of vertically spaced apart rows of inverted V-shaped cuts extending horizontally across said sheet with each row of inverted V-shaped cuts being positioned between two rows of upright V-shaped cuts, each shaped cut having a central axis bisecting the angle formed between the legs thereof which axis is aligned in said vertical dimension and further having one leg cut longer than the other leg with the long cut of each shaped cut being adjacent the short cut of the next adjacent shaped cut within each row of cuts, the ends of the long cut and short cut of two adjacent shaped cuts terminating generally in the base of one of the shaped cuts in the adjacent row of cuts with the end of the long cut of one shaped cut being horizontally aligned substantially with the end of the short cut of the vertically adjacent shaped cut in the adjacent row of cuts, whereby stretching said material in a direction transverse to the rows of shaped cuts extend the apexes of the V-shaped cuts in one row upwardly out of the plane of the sheet away from said top surface with the apexes of the next adjacent row of cuts extending downwardly out of said plane away from said bottom surface, said V-shaped cuts projecting from said surfaces substantially straight relative to the plane of said sheet to prevent viewing of both of said surfaces simultaneously from one side of said sheet, wherein the vertical component of each said long cut is from 17% to 33% of the apex-to-apex distance between vertically aligned shaped cuts.

4. Camouflage means for preventing visual and radar detection of objects concealed thereby, said camouflage means comprising a planar sheet of camouflage material having a first vertical planar dimension and a second horizontal planar dimension substantially perpendicular to said vertical dimension, a top planar surface and a bottom planar surface, a plurality of vertically spaced apart rows of upright V-shaped cuts extending horizontally across the sheet, said V-shaped cuts having a central axis bisecting the angle formed between the legs thereof which axis is aligned in said vertical dimension, a plurality of vertically spaced apart rows of inverted V-shaped cuts extending horizontally across said sheet with each row of inverted V-shaped cuts being positioned between two rows of upright V-shaped cuts, each upright V-shaped cut in each row of upright cuts being further aligned in a vertical column of upright V-shaped cuts and each inverted V-shaped cut in each row of inverted cuts being further aligned in a vertical column of inverted V-shaped cuts which column is positioned between spaced vertical columns of the upright V-shaped cuts, each V-shaped cut having one leg cut longer than the other leg with the long leg of each V-shaped cut being adjacent the short leg of the next adjacent V-shaped cut within each row of cuts, the apexes of the V-shaped cuts in alternate rows of cuts projecting substantially straight out of the plane of said top planar surface and the apexes of the next adjacent rows of V-shaped cuts projecting substantially straight out of the plane of said bottom planar surface when said planar sheet is subjected to a tension force in said vertical direction to decrease the radar signature of said sheet and improve the controllability and predictability of see-through factor of said camouflage while preventing simultaneous viewing of both said surfaces from one side of said sheet, wherein the long leg of each said V-shaped cut is defined by a vertically aligned component and a horizontally aligned component, and the distance from an apex of one V-shaped cut to the apex of the next vertically adjacent V-shaped cut is from 17% to 33% greater than the vertically aligned component of said long leg.

5. The camouflage means of claim 4, wherein the long leg and the short leg of each V-shaped cut is each defined by a vertically aligned component and a horizontally aligned component, and wherein the vertically aligned component of the long leg is in the range of from 12 percent to 25 percent greater than the vertically aligned component of the short leg of each said V-shaped cut.

6. The camouflage material as described in claims 1, 3 or 5 wherein said angle formed between said legs of each said V-shaped cut is approximately 60°–70°.

* * * * *